US005121164A

United States Patent [19]

Landa et al.

[11] Patent Number: 5,121,164

[45] Date of Patent: * Jun. 9, 1992

[54] METHOD FOR MAINTAINING A LIQUID COMPOSITION

[75] Inventors: Benzion Landa, Edmonton, Canada; Yehuda Niv, Rehobot, Israel; Israel Grossinger, Rehobot, Israel; Moshe Levanon, Rehovot, Israel; Yossi Adam, Rehovot, Israel

[73] Assignee: Spectrum Sciences B.V., Rotterdam, Netherlands

[ * ] Notice: The portion of the term of this patent subsequent to Aug. 7, 2007 has been disclaimed.

[21] Appl. No.: 202,514

[22] Filed: Jun. 6, 1988

[51] Int. Cl.[5] ..... G03G 15/06; G03G 15/10

[52] U.S. Cl. ..... 355/246; 430/54; 356/411; 250/226; 355/256; 355/208; 355/326

[58] Field of Search ..... 355/246, 256, 326, 209, 355/208, 257, 258; 430/54; 356/410, 411; 250/226; 118/645, 651-652

[56] References Cited

U.S. PATENT DOCUMENTS

| | | | |
|---|---|---|---|
| 3,381,662 | 5/1968 | Kolb et al. . | |
| 3,793,205 | 2/1974 | Metcalfe et al. . | |
| 4,068,938 | 1/1978 | Robertson | 355/4 |
| 4,111,151 | 9/1978 | Ruckdeschel . | |
| 4,264,185 | 4/1981 | Ohta | 355/4 |
| 4,562,129 | 12/1985 | Tanaka et al. | 430/42 |
| 4,785,327 | 11/1988 | Landa et al. | 355/256 |
| 4,947,201 | 8/1990 | Niv et al. | 355/256 |
| 5,012,300 | 4/1991 | Levanon et al. | 355/328 |

FOREIGN PATENT DOCUMENTS 55-124156 9/1980 Japan .

*Primary Examiner*—A. T. Grimley
*Assistant Examiner*—Matthew S. Smith
*Attorney, Agent, or Firm*—Sandler, Greenblum & Berstein

[57] ABSTRACT

A method for maintaining a preselected concentrations of first and second charge directors in a toner composition, where such composition is being subjected to a use in which initial concentrations of the first and second charge directors are being depleted.

4 Claims, 5 Drawing Sheets

METHOD FOR MAINTAINING A LIQUID COMPOSITION

FIELD OF THE INVENTION

The present invention relates generally to electrostatic imaging, and particularly to single pass two color electrophoretic methods of electrostatic imaging.

BACKGROUND OF THE INVENTION

In electrostatic image reproduction, it is known to print two or more superimposed colors on a substrate by separate operations. Printing in two colors is useful, for example, when it is desired to highlight particular sections of documents such as in accounts, where material may be typewritten in two colors, in stationery with two printed colors and so forth. Printing (or copying) in two or more colors generally requires a process which incorporates two passes as well as accurate registration of the two or more superimposed colors.

In U.S. Pat. No. 4,068,938 (Robertson), there is described a process in which a two color plus background copy is obtained from a two color plus background original. According to Robertson's concept, the pairs of colors are chosen according to the response characteristics of the photoconductive surface on which the electrostatic latent image is formed. Thus the electrostatic latent image is characterized by a high level of potential corresponding to locally uniform areas of one of the colors, an intermediate level of potential corresponding to locally uniform areas of the second color, and a low level of potential corresponding with locally uniform areas of the background.

There are two steps in the development of the image in this process: (1) particles of one color are attracted to areas of the electrostatic latent image of high potential and (2) particles of a second color are attracted to areas of low potential. Thus, in the resultant copy, the second color of the original is not reproduced per se but is represented by the color of the copy sheet which can of course be chosen to correspond to the second color of the original. It should be noted that this process depends in practice on the provision of different inks in separate baths so as to develop in separate steps two different areas of the electrostatic latent image.

In contrast to Robertson, U.S. Pat. No. 4,264,185 (Ohta) describes a process in which areas of an electrostatic latent image corresponding to two colors in an original document are developed (rather than one color plus background). Ohta's process applies toners of different colors and polarities to the latent image, in separate steps. In order to repel other, undesired toner particles from one development unit, a bias voltage of opposite polarity is applied to the latter unit, and vice-versa.

Ohta's process may use separate baths of the two toners, or a single partitioned bath with liquid communication between the compartments. Even where a single partitioned bath is used, the latent image is developed in two distinct steps. It is unclear from the disclosure in this patent how the question of clean-up of the background is to be dealt with, if at all.

Ohta's process is based on the premise that two oppositely charged types of toner particles, if mixed in the same bath, tend to electrically neutralize each other, thus producing an electrostatically neutral substance incapable of producing a toner image. As described herein, the present invention is based on the contradictory premise that two oppositely charged types of toner particles mixed in the same bath can coexist, and the mixture will in fact be capable of producing toner images.

In U.S. Pat. No. 4,562,129 (Tanaka), there is described a method of forming monochromatic or dichromatic copy images by use of a developer comprising a high-resistivity magnetic carrier and a nonmagnetic insulating toner which are triboelectrically chargeable, with the result that the toner and carrier adhere to first and second image portions, respectively, of the electrostatic latent image which has at least three levels of potential.

In "Experimental Example 1" of Tanaka, a toner of 14 microns mean particle size and resistivity of at least $10^{15}$ ohm-cm, triboelectrically chargeable to positive polarity, comprised styrene-acrylic copolymer (100) and red colored charge controlling pigment (5); while a carrier of 20 microns mean particle size, resistivity of $10^{14}$ ohm-cm, triboelectrically chargeable to negative polarity, comprised styrene-acrylic copolymer (100), magnetic fine powder (200), carbon black (4) and silica fluidity agent (1.5); parts indicated in parentheses are by weight. The developer comprised a 1:9 mixture of toner and carrier.

The disclosures of U.S. Pat. Nos. 4,068,938, 4,264,185 and 4,562,129 are incorporated by reference herein.

Reference is now made to the following published patent applications and issued patents in the field of electrophotography: GB published Patent Applications Nos. 2,169,416A and 2,176,904A and U.S. Pat. Nos. 3,990,696, 4,233,381, 4,253,656, 4,256,820, 4,269,504, 4,278,884, 4,286,039, 4,302,093, 4,326,644, 4,326,792, 4,334,762, 4,350,333, 4,355,883, 4,362,297, 4,364,460, 4,364,657, 4,364,661, 4,368,881, 4,378,422, 4,392,742, 4,396,187, 4,400,079, 4,411,976, 4,412,383, 4,413,048, 4,418,903, 4,420,244, 4,435,068, 4,439,035, 4,454,215, 4,460,667, 4,473,865, 4,480,825, 4,501,486, 4,522,484; 4,531,824, 4,538,899, 4,582,774, 4,585,329, 4,586,810, 4,589,761, 4,598,992, 4,603,766, 4,620,699, 4,627,705, 4,678,317, the disclosures of which are incorporated by reference herein.

SUMMARY OF THE INVENTION

There is provided in accordance with the present invention a method for maintaining a preselected concentrations of first and second charge directors in a toner composition, where such composition is being subjected to a use in which initial concentrations of the first and second charge directors are being depleted, and comprising at least one of the following steps:

(a) measuring the optical densities of color patches developed using the toner composition, in order to determine the relative concentrations of the first and second charge directors in the liquid toner composition;

(b) measuring the conductivity of a sample of toner composition in order to determine the concentration of the first and second charge directors therein by reference to information derived from conductivity measurements on reference compositions containing known concentrations of the first and second charge directors;

(c) measuring the amount of absorption of light at a preselected wavelength by a sample of toner composition from which pigmented particles have been removed; and adjusting the amounts of the constituents of the depleted composition by the difference between the determined concentrations and the preselected proportions of the first and second charge directors, in order to restore the preselected proportions to the depleted composition.

BRIEF DESCRIPTION OF THE DRAWINGS

The present invention will be more fully understood and appreciated from the following detailed description, taken in conjunction with the drawings, in which.

DETAILED DESCRIPTION OF THE INVENTION

Figure 1:
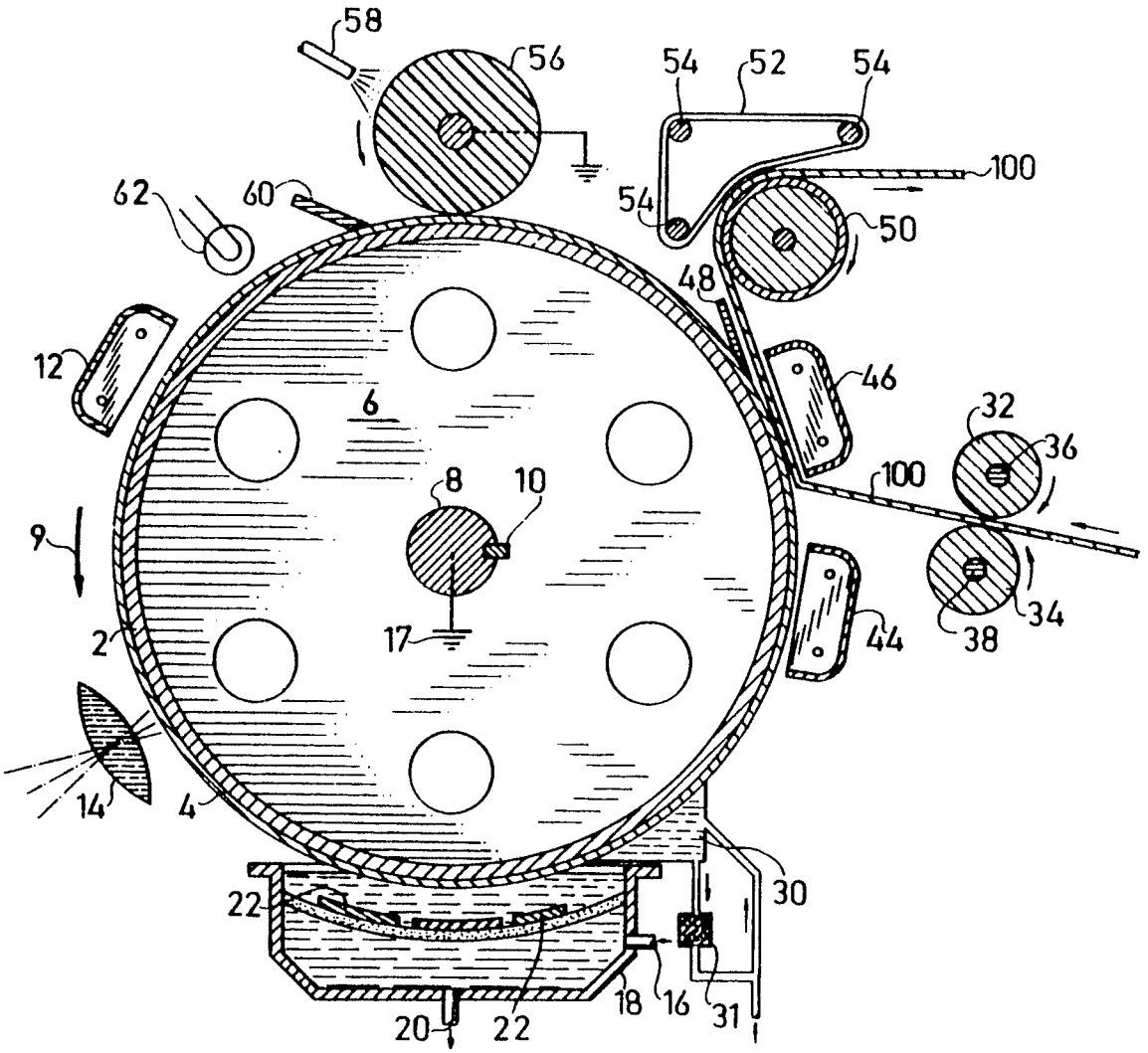
FIG. 1 is a schematic sectional illustration of apparatus useful in carrying out the process of the invention.

Referring to FIG. 1 there is shown electrostatic imaging apparatus employing a liquid toner composition comprising two oppositely charged and differently colored pigmented particles. There is shown a metal drum 2 which carries a photoconductor 4 and which is mounted by disks 6 onto a shaft 8 to which the disks are secured by a key 10 so that the shown assembly, which is provided in a light-proof housing (not shown) is operative to rotate a shaft 8.

Figure 2A:
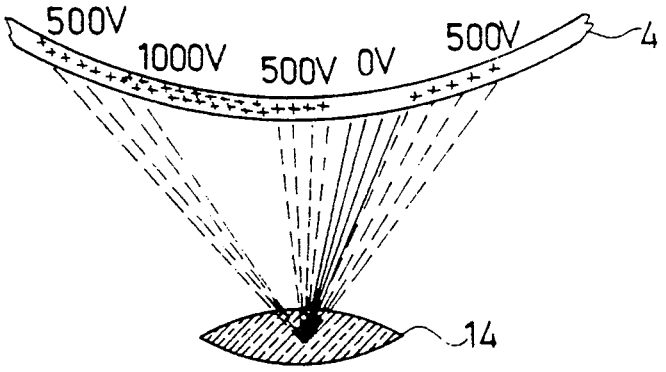
FIGS. 2A to 2D illustrate, in schematic fashion, various steps of dichromatic electrostatic imaging according to an embodiment of the invention.
Figure 2B:
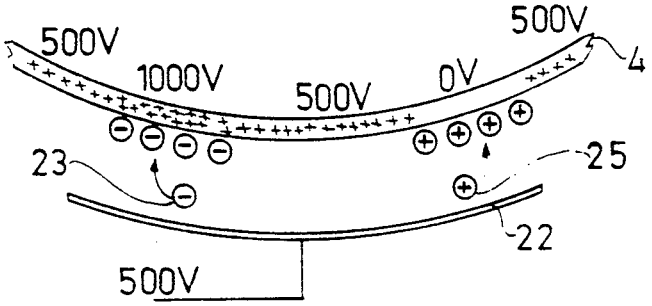

Shaft 8 is driven in any appropriate manner (not shown) in the direction of arrow 9 past a corona discharge device 12 adapted to charge the surface of the photoconductor 4. The image to be reproduced is focused by a lens 14 upon the charged photoconductor. Since shaft 8 is grounded at 17 and disks 6 are conductive, the areas struck by light conduct the charge, or a portion thereof, to ground, thus forming an electrostatic latent image. Formation of the electrostatic latent image in this way is shown in FIG. 2A.

The developing liquid containing two different pigmented particles, as described herein, is circulated from any suitable source (not shown) through a pipe 16 into a development tray 18 from which it is drawn through a pipe 20 for recirculation. Development electrodes 22, which may be appropriately biased as known to the art, assist in toning the electrostatic latent image as it passes into contact with the developing liquid.

Referring now to FIG. 2, charged toner particles referenced 23 and 25, suspended in the carrier liquid, travel by electrophoresis to the electrostatic latent image. If, as shown in FIG. 2B, photoconductor 4 is positively charged, e.g. if a selenium photoconductor is used, negatively charged pigmented particles 23 will travel to electrostatic latent image areas having generally the highest positive potential, here shown at 1000 V, while positively charged pigmented particles 25 will travel to the latent image areas having generally the lowest positive potential of 0 V. It is noted that the background, or the area to which neither particles 23 nor particles 25 are attracted, carries a charge of typically 500 V.

If the photoconductor is negatively charged, e.g. if a cadmium sulfide photoconductor is used, negatively charged pigmented particles travel to electrostatic latent image areas having generally the lowest negative potential, while positively charged pigmented particles travel to the latent image areas having generally the highest negative potential.

Figure 2C:
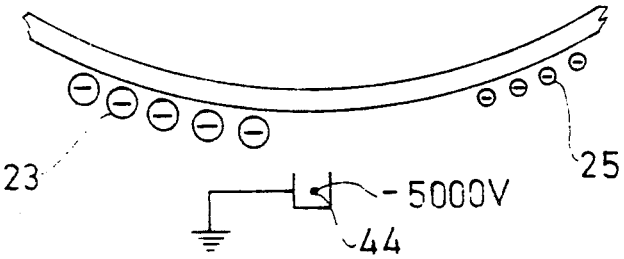

With particular reference to FIG. 2C, the developed image, from which excess liquid has been removed during background clean-up at 30 and which contains differently pigmented areas having respectively positive and negative charges, is passed under a corona discharge device 44, which imposes, for example, a negative DC electrical discharge so as to convert image areas of positive charge to a negative charge and image areas of negative charge to a relatively greater negative charge.

According to the shown example, particles 23 now carry a greater negative charge than before and particles 25, which previously carried a positive charge, now carry a relatively small negative charge. As the entire developed image now carries a charge of single polarity, transfer of the image to a carrier sheet 100 may be effected, as described below in detail, by provision of a single corotron operative to charge the sheet to a polarity opposite to that of the developed image.

In an alternative embodiment, the negative DC electrical discharge may be combined with AC electrical discharge so as to narrow (or if desired to reduce to zero) the difference in surface potentials between the differently pigmented areas, in order to compensate for excess of one or more pigmented particles in the image.

Figure 2D:
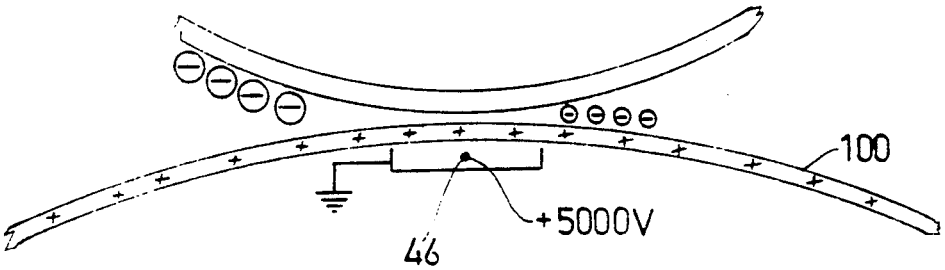

A pair of register rollers 32 and 34 is adapted to feed a carrier sheet 100, which is to receive the developed image, to a transfer station, where, as shown particularly in FIG. 2D, a corona discharge device 46 is operative to impress upon the rear of the carrier sheet a charge of polarity opposite to that of the toner particles forming the image after electrical treatment of the image at 44. The developed image is thus drawn towards the carrier sheet.

Rollers 32 and 34 are mounted onto and secured for rotation with respective axles 36 and 38. The axles are driven in synchronism so that there is no relative motion between the points of closet approach of the rollers 32 and 34 to each other. Alternatively, if desired, only one of the register rollers need be driven.

A pick-off member 48 assists in the removal of the carrier sheet bearing the developed image from the photoconductor. A roller 50 coacting with a plurality of flexible bands 52 delivers the carrier sheet to an exit tray (not shown). The flexible bands are mounted onto a plurality of rollers 54.

A cleaning roller 56, formed of any appropriate synthetic resin known to the art for this purpose, is driven in a direction of rotation opposite to that of the photoconductor, to scrub clean the surface thereof. To assist in this action, insulating, nonpolar liquid may be fed through a pipe 58 to the surface of the cleaning roller 56. A wiper blade 60 completes the cleaning of the photoconductive surface. Any residual charge left on the photoconductive drum is neutralized by flooding the photoconductor surface with light from a lamp 62.

Figure 3:
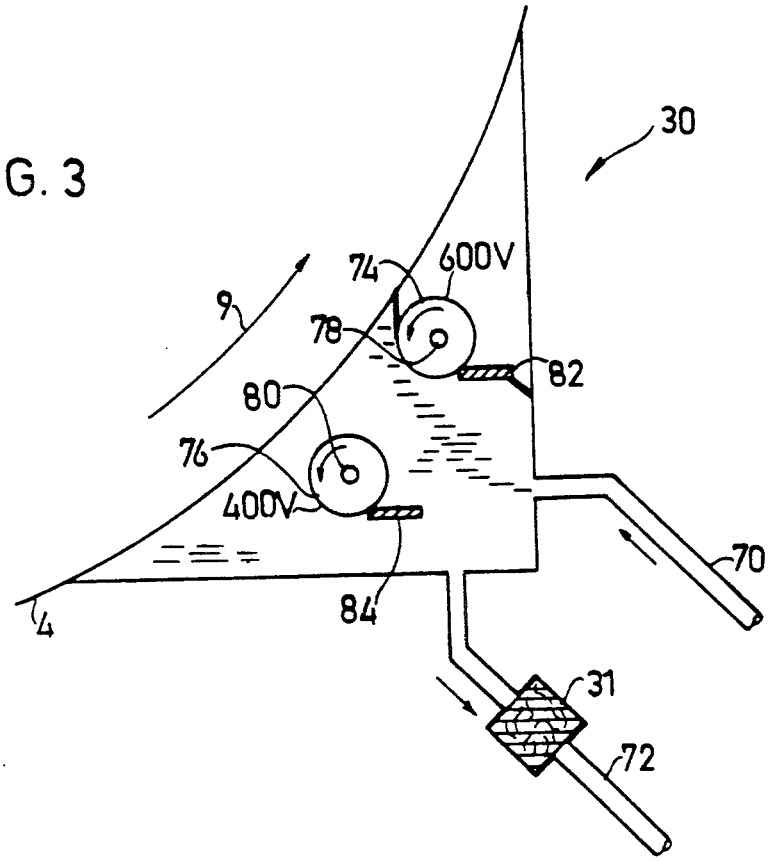
FIG. 3 is an enlarged schematic sectional illustration of apparatus shown in FIG. 1 for cleaning the background of the developed image.

As shown in FIG. 3, a background clean-up unit, referenced generally 30, comprises, according to the shown embodiment, a pair of rollers 74 and 76 which are rotated (by means not shown) on axles 78 and 80 in the indicated direction, counter to that of photoconductor surface 4. Background clean-up unit 30 is also operative to remove excess liquid from the photoconductive surface 4, by virtue of the reverse rotation of roller 74 as indicated in FIG. 3. The use of a reverse rotating roller for removal of excess liquid is described in U.S. Pat. No. 3,907,423, the disclosure of which is incorporated herein by reference.

By way of example, it will be supposed that the image includes negative black toner particles developed at 1000 volts positive potential, positive red toner particles developed at zero potential and background potential at 500 volts.

Roller 74 is charged with a positive potential of, for example, 600 volts and thus attracts black particles from the background while preventing detachment of red toner particles from the image. Roller 76, however, is charged with a positive potential of, for example, 400 volts and thus attracts red particles from the background while preventing detachment of black toner particles from the image. Rollers 74 and 76 are provided with respective wiper blades 82 and 84 for removal and transfer of adherent pigmented particles to circulating insulating, nonpolar liquid which may be fed into the clean-up unit through a pipe 70 and out through a pipe 72.

According to an alternative embodiment of the invention, as the liquid passes through pipe 72 in the shown direction, any pigmented particles suspended in the liquid are removed by a filter 31, which may be any type of conventional filtering apparatus suited for this purpose. The filtered liquid may subsequently be recirculated into clean-up unit 30 via pipe 70.

Although in theory roller 76 will attract only red particles and roller 74 will attract only black particles, it is in practice to be expected that some black particles will be repelled from roller 76 towards the photoconductor surface 4 and that some red particles will be repelled from roller 74 towards the photoconductor surface 4.

In order to ensure that any particles so repelled are prevented from returning to the photoconductor surface 4, rollers 74 and 76 are spaced about 50 to 200 microns apart, so that any black particles repelled by roller 76 are attracted to roller 74 and any red particles repelled by roller 74 are attracted to roller 76.

The insulating, nonpolar liquid used as the medium for toner particles as well as for other optional purposes as described herein, preferably has a resistivity in excess of about $10^9$ ohm-cm and a dielectric constant below about 3.0. Suitable such liquids are hydrocarbons, preferably aliphatic and more preferably isomerized aliphatic hydrocarbons, as, for example, those marketed by Exxon Corporation under such trade marks as ISOPAR-G, ISOPAR-H, ISOPAR-L and ISOPAR-M, which meet the preferred resistivity and dielectric requirements.

Polymers useful as binders for the pigmented particles may be thermoplastic. The presently preferred polymers are known under the trade mark ELVAX II, manufactured by E.I. Du Pont de Nemours & Company. The ELVAX II family are ethylene copolymers combining carboxylic acid functionality, high molecular weight and thermal stability.

The presently preferred ELVAX II resins are those designated 5720 and 5610. Other polymers which may be used are the ELVAX polymers and the ethylene/ethyl acrylate series made by Union Carbide such as those designated DPD 6169, DPDA 6182 Natural and DTDA 9169 Natural. Still other useful polymers made by Union Carbide are those designated DQDA 6479 Natural 7 and DQDA 6832 Natural 7; these are ethylene/vinyl acetate resins.

The polymers are pigmented so as to render the latent image visible in two colors. The pigments may be present generally in an amount of 1–60% by weight with respect to the weight of the polymer. The selection of two pigments from the examples listed in the description which follows or/and from those otherwise known in the art may be readily performed by the skilled person.

As has been set out above, in an electrostatic imaging process in which the composition of the invention is utilized, two colors are developed simultaneously by use of a toner liquid composition which comprises an insulating, nonpolar liquid having admixed therewith two different pigmented particles carrying opposite charges. It should be emphasized that the choice of colors of the pigmented particles is entirely at the discretion of the person operating the process, subject only to the condition that the pigmented particles should be adapted to be oppositely charged in the same medium.

Illustrative examples of potentially suitable pigments are Cabot Mogul L (black), Monastral Blue G (C.I. Pigment Blue 15 C.I. No. 74160), Quindo Magenta (Pigment Red 122), Indo Brilliant Scarlet Toner (Pigment Red 123, C.I. No. 71145), Dalamar Yellow (Pigment Yellow 74, C.I. No. 11741), blue pigment BT-383D (DuPont), yellow pigment YT-717D (DuPont), red pigment RT-455D (DuPont) and blue pigment Helioecht Blue GO (Bayer).

One of the two pigments may be, if desired, a finely ground ferromagnetic material, e.g. Mapico Black. Other suitable materials are metals including iron, cobalt, nickel and various magnetic oxides including $Fe_2O_3$ and $Fe_3O_4$; and others known in the art. Mixtures of known magnetic materials may also be used.

In general, the liquid toner composition employed in the process of the invention may be prepared by a method which comprises the steps of: separately wet-grinding two pigments, which are respectively adapted to acquire charges of opposite polarities, preferably together with a thermoplastic polymeric binder for the pigments, in an inert medium until homogeneous and until the dispersed solids have predetermined characteristics selected from the group consisting of a desired particle size range and a fibrous structure; and polarizing the pigmented particles in the resultant wet-ground composition, whereby the pigmented particles acquire charges of opposite polarities, respectively.

The polarizing step is preferably carried out by addition of either one or two charge directors to the wet-ground composition, as otherwise described herein.

More particularly, the liquid toner composition may be prepared (e.g.) by initially mixing a suitable polymer together with a plasticizer and separately with each of the two selected pigments, until homogeneity is achieved. Thereafter, the mixture is allowed to cool while mixing is continued. The mixing temperature may range from about 65° to about 100° C., preferably about 90° C. Mixing times prior to cooling, typically about 90 minutes, may range between about 10 minutes and 3 hours. Any suitable mixing or blending device may be employed, such as the Ross double planetary mixer (manufactured by Charles Ross & Son of Hauppauge, N.Y.

After the mixture has been cooled, it is charged to an attritor, disk mill, sand mill, impeller attrition mill, vibroenergy mill, or the like. The liquid used during the grinding operation may be e.g., ISOPAR-H, which is present in an amount of 70-90% by weight in respect of the polymer. During the grinding, the particle size is determined for example by centrifugal analysis using e.g. a Horiba Centrifugal Particle Size Analyzer, Model CAPA 500, manufactured by Horiba Instruments Inc. of Irvine, Calif.

The ground material for each pigment is then dispersed e.g. in ISOPAR-H and mixed with a charge director to form a working dispersion having a solids content of about 0.5 to about 3% by weight. The amount of charge director is dependent on its characteristics and the requirements of the use of the particular toner in question. The working dispersions for both pigments are then combined or alternatively they may be combined prior to mixing with the charge director.

As mentioned above, charge directors may be used in the present invention in either one of two ways. It has been surprisingly found, in accordance with one embodiment of the invention, that a single charge director may be used to induce opposite charges on two different pigmented particles, respectively. The use of a single charge director in conjunction with the selection of two suitable pigmented particles may be done as e.g. is illustrated in certain of the Examples, below.

In accordance with another embodiment of the invention. two charge directors are used simultaneously in the same composition, whereby there is induced a positive charge on one species of particles and a negative charge on the other species of particles. Illustration of the use of two charge directors is given in certain of the Examples below.

In view of the prior art teaching that mixing oppositely charged toner particles would electrically neutralize them and thus render them useless for developing an electrostatic latent image, it is surprising that in contrast to such prior art teaching, the embodiment of the present invention just described is operable, insofar as it has been found by the present inventors that oppositely charged toner particles can exist in the same liquid toner composition, which phenomenon is thus of practical utility in the present context.

Examples of charge directors which according to the prior art were regarded as inducing negative charges are e.g. magnesium, calcium and barium petronates; aluminum stearate, metal dialkylsulfosuccinates, other metal soaps such as copper oleate, and lecithin.

Examples of charge directors which according to the prior art were regarded as inducing positive charges are e.g. manganese naphthenate, manganese octoate, zirconium octoate and cobalt octoate.

It will be appreciated by persons skilled in the art that the mechanism of charge on pigmented particles is not fully understood. The determination of polarity and degree of charge on pigmented particles is usually determined empirically, by trial and error.

When using a toner liquid which in accordance with the invention comprises two different pigmented particles, it is evidently advantageous to monitor the amount of these pigmented particles at any particular time, in order to know the amounts of each which need to be added to bring their respective concentrations in the liquid up to the desired level.

Figure 4:
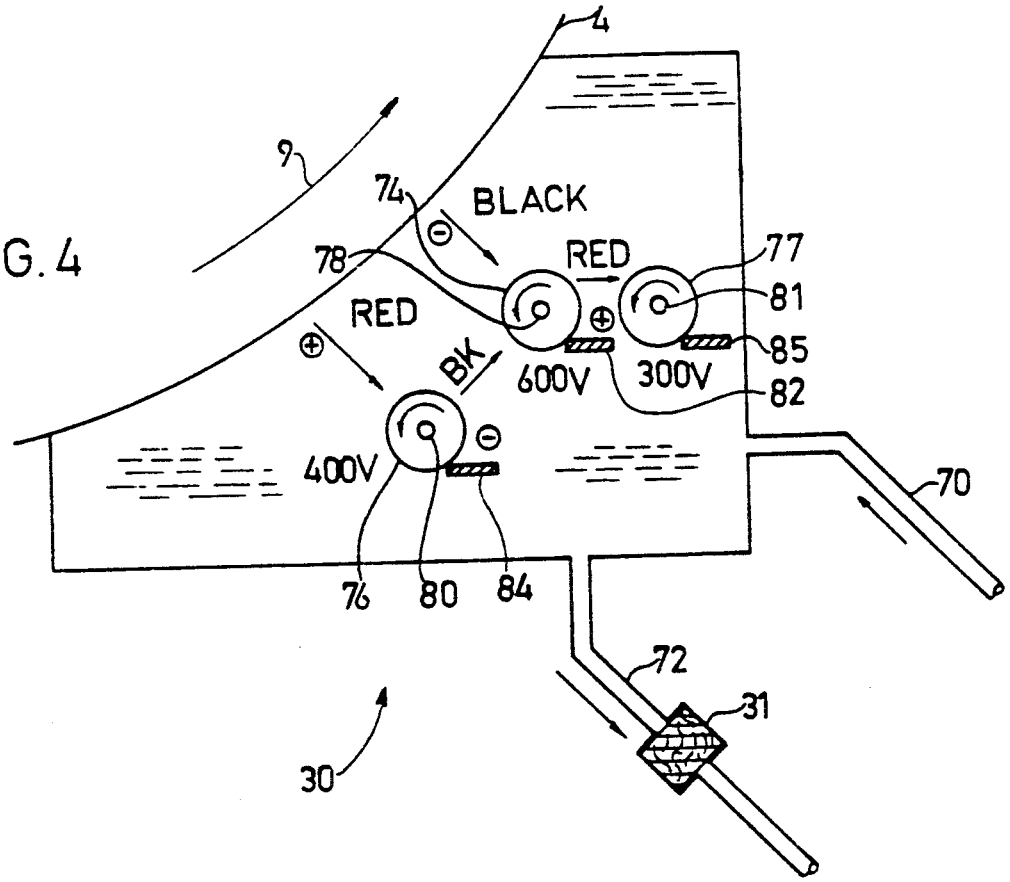
FIG. 4 is a schematic illustration of a pigmented particle replenishment system useful in association with the apparatus shown in FIG. 1.

Referring now to FIG. 4, there is shown a two pigmented particle monitoring and replenishment system. Monitoring may be effected, for example, by measuring the optical density of the toner liquid as it passes through development tray feed pipe 16. This may be effected by way of two LEDs (light emitting diodes) referenced 92 and 94, emitting two different wavelengths of light and by a pair of connected light detectors, referenced 96 and 98, respectively.

The different light wavelength intensities are passed on, as in digital form, to a microprocessor 90, which contains information useful in correlating the different light wavelengths intensities with concentrations of the two pigmented particles. The information contained in the microprocessor may be compiled by means of studies on similar liquids containing known concentrations of the two pigmented particles.

By way of example, it is assumed that black and blue pigmented particles are used and that the blue pigmented particle is blue light transparent and red light absorbing. For example, detector 96 utilizing blue light may thus be used to determine the concentration of black pigmented particles, while a detector 98 utilizing red light may be similarly used to determine the total concentration of the two pigmented particles; thus the concentrations of both pigmented particles in the toner liquid may be determined.

Figure 5:
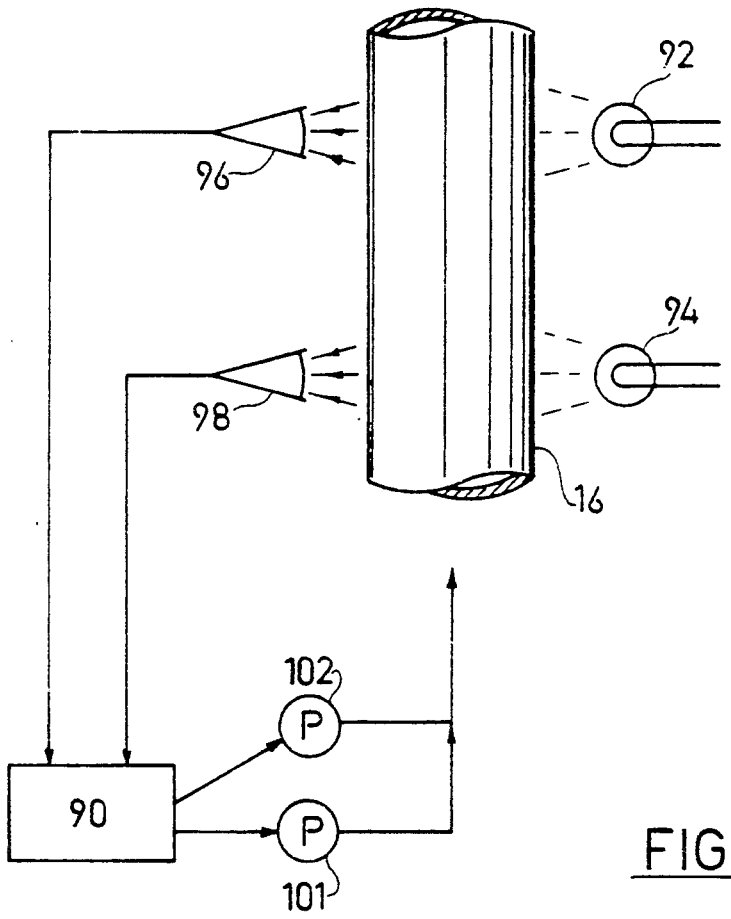
FIG. 5 is a flow chart showing operation of microprocessor apparatus useful in the pigmented particle replenishment system shown in FIG. 4.
Figure 6:
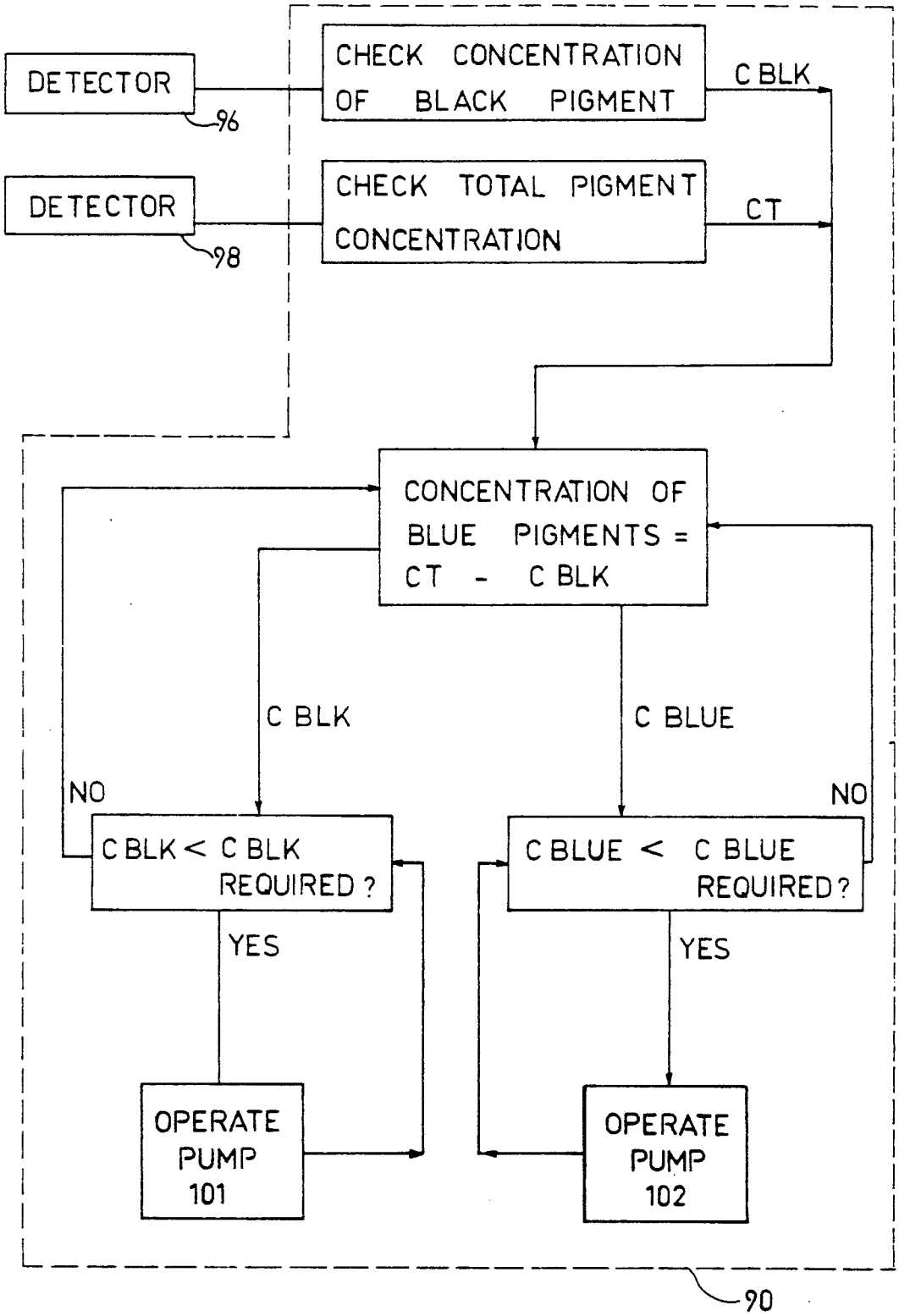

Referring additionally to FIG. 5, upon receiving input from detectors 96 and 98 as described, microprocessor 90 is programmed to operate either or both pigmented particle pumps, respectively referenced 101 and 102, once it has determined that the concentration of either or both of the pigmented particles has fallen below a desired concentration. In this way, continuous regulation and, if necessary, replenishment, of the pigmented particles is possible.

It is also clearly advantageous to be able to monitor the amount of charge director in a given toner liquid, in order to know the amount needed for replenishment, i.e. to bring its concentration in the toner liquid up to the desired level. By way of example, this may be effected by compiling tables relating the conductivity of a toner liquid to various concentrations of the particular charge director therein and, when required, measuring the conductivity of operational toner liquid for determination of the charge director concentration by reference to the tables.

When, in accordance with a particular embodiment of the invention, there are employed two charge directors in the same toner liquid which may not necessarily be depleted (and/or the reverse) at the same rate, it appears unlikely that conductivity measurements alone could give the necessary information as to the nature of the adjustment to be made in the concentrations. In this instance it may, therefore, be necessary to measure a different physical property, e.g. the amount(%) of absorption of light at particular wave lengths, on the clear liquid (a sample of which may prepared, for example, electrophoretically). The obtained light absorption information should also be correlated with pre-prepared tables. It is evident that the combination of conductivity and light absorption measurements enables determination of the amount of each charge director to be added to the liquid, and also that such measurements and determination are within the competence of a person skilled in the art.

A further indication of the depletion of charge director(s) in the toner liquid may be obtained by developing patches of each color and measuring their optical densities. Optical densities which are too high indicate depletion of charge director(s), while the contrary is indicated by optical densities which are too low. Such information could be utilized in conjunction with that obtained from conductivity measurements and also from light measurements, as applicable.

When using the dual color toner composition for development, it is necessary that the electrostatic latent image to be developed comprises areas of high, low and intermediate levels of electrostatic charge. In order to generate these three levels of charge, it will be most convenient, for example, to start with material to be copied which has a uniform grey background, besides white and black areas, such as white and black typed areas, which could be imaged by conventional optical means onto the photoreceptor.

In this example, the grey will be represented in the latent image by an intermediate charge level, while the white and black areas will be represented by the two other levels of charge. In a printer, the three charge levels could be generated, for example, by modulating the power of the exposing laser beams (in a laser printer) or the amount of charge which is supplied to a latent image holding substrate (in an electrostatic or ionographic printer).

Thus, in general terms, the invention need not be applied to copy colors which are similar to those in a colored original. As those skilled in the art will be aware, a process including copying similar colors can be made feasible by the combined use of color filters, a reading element and a printing head, with the result that the colored original will be stored and used in the form of digital information which may be utilized so as to give the desired three level latent image.

The invention will now be illustrated by the following non-limiting examples. The formulations of the examples were used to develop latent images from black and white Letraset originals which had either a grey or colored background. The electrostatic imaging response of the photoconductor results in a latent image composed of areas of approximately 1300 V (first color) and 50 V (second color) on a 600 V background. The development bias and reverse roll bias were each set at about 600 V.

When using the formulations of Examples I–IV, the developed image was removed from the photoconductor surface with Scotch tape, in a Savin 870 copier. When using the formulations of Examples V–VII, the developed image was transferred to paper using an additional pre-transfer corotron with a standard Savin 870 copier configuration. When using the formulation of Example VIII, the developed image was transferred to paper using an additional pre-transfer corotron with a test copier configuration, and in addition a separate background cleaning station with clear liquid input, as described herein, was employed.

Examples I–IV and VI illustrate an embodiment of the invention in which a single charge director suffices for the two pigmented particles in the toner compositions to become oppositely charged. Examples V, VII and VIII illustrate an embodiment of the invention in which two charge directors are used to render the two pigmented particles in the toner compositions oppositely charged.

EXAMPLE I (a) 1000 g. Elvax II 5720 resin (DuPont) and 500 g. Isopar L were mixed in a Ross double planetary mixer for 1 hour at 90° C., then for a further hour after addition of 250 g. Mogul L carbon black (Cabot) which had been wetted by 500 g. Isopar L, and finally for another hour after addition of 2000 g. Isopar L preheated to 110° C. Stirring was continued in absence of heating until the temperature reached 40° C. 3050 g. of the resultant mixture was milled in a Sweco M-18 vibratory mill (containing 0.5" alumina cylinders) with 4000 g. Isopar L for 20 hours at 34° C.; the average particle size of the product was 2.4 microns.

(b) 1200 g. Elvax II 5720 (DuPont) and 1000 g. Isopar L were mixed together in a Ross double planetary mixer at 90° C. for 1 hour; 2600 g. preheated Isopar L were then added and the mixing continued for a further 30 minutes at 100° C. The mixture was allowed to cool while continuing stirring until the temperature reached 40° C.

(c) An S-O attritor with 3/16" stainless steel balls was charged with 125 g. of the product from part (b), 2.5 g. blue pigment BT-383D (DuPont), 0.2 g. nigrosine (Solvent Black 7, Bayer) and 80 g. Isopar L. The mixture was ground for 15 hours; the final average particle size was 2.6 microns.

(d) The product of part (c) was diluted to a 1.5% solids content with Isopar H, and 800 grams of it were mixed with 800 g. of the diluted product of part (a), which had already been separately diluted to a 1.5% solids content with Isopar H, and with 15 ml. of 6% Zirconium Octoate (ICN Biomedicals K+K Labs.). In this mixture, the Zirconium Octoate charge director renders the black pigmented particles negatively charged and the blue pigmented particles positively charged.

EXAMPLE II (a) 500 g. Elvax II 5720 (DuPont) and 500 g. Isopar L were mixed together in a Ross double planetary mixer at 90° C. for 1 hour. Then 80 g. Cab-O-Sil M5 (Cabot) and 58.6 g. YT-717D yellow pigment were added and mixing was continued for 30 minutes; 1000 g. preheated Isopar L were then added and the mixing continued for 1 hour. The mixture was allowed to cool while continuing stirring until the temperature reached 40° C.

(b) 535 g. of the product of part (a) and 803 g. Isopar L were ground together in a Sweco M-18/5 VM-2 vibratory mill with 0.5" alumina grinding medium for 250 hours; the average particle size of the product was 1.96 microns.

(c) The product of part (b) was diluted to a 1.5% solids content with Isopar H, and 800 grams of it were mixed with 800 g. of the diluted product of part (a) of Example I, which had already been separately diluted to a 1.5% solids content with Isopar H, and with 8 ml. of 6% Zirconium Octoate (ICN Biomedicals K+K Labs.). In this mixture, the Zirconium Octoate charge director renders the black pigmented particles negatively charged and the yellow pigmented particles positively charged.

EXAMPLE III (a) An S-O attritor with 3/16" stainless steel balls was charged with 100 g. of the product from part (b) of Example I, 2 g. red pigment RT-455D (DuPont), 0.2 g. nigrosine (Solvent Black 7, Bayer) and 80 g. Isopar L.

The mixture was ground for 24 hours; the final average particle size was 1.6 microns.

(b) The product of part (a) was diluted to a 1.5% solids content with Isopar H, and 750 grams of it were mixed with 750 g. of the diluted product of part (a) of Example I, which had already been separately diluted to a 1.5% solids content with Isopar H, and with 15 ml. of 6% Manganese Naphthenate (ICN Biomedicals K+K Labs.). In this mixture, the Manganese Naphthenate charge director renders the black pigmented particles negatively charged and the red pigmented particles positively charged.

EXAMPLE IV (a) An S-O attritor with 3/16" stainless steel balls was charged with 100 g. of the product from part (b) of Example I, 2 g. red pigment RT-455D (DuPont), 0.2 g. Dimanine (quaternary ammonium salt, Bayer) and 80 g. Isopar L. The mixture was ground for 24 hours; the final average particle size was 1.6 microns.

(b) The product of part (a) was diluted to a 1.5% solids content with Isopar H, and 1200 grams of it were mixed with 1200 g. of the diluted product of part (a) of Example I, which had already been separately diluted to a 1.5% solids content with Isopar H, and with 12 ml. of 6% Manganese Naphthenate (ICN Biomedicals K+K Labs.). In this mixture, the Manganese Naphthenate charge director renders the black pigmented particles negatively charged and the red pigmented particles positively charged.

EXAMPLE V (a) 1000 g. Elvax II 5720 (DuPont) and 1000 g. Isopar L were mixed together in a Ross double planetary mixer at 90° C. for 1 hour. Then 60.2 g. Cab-O-Sil M5 (Cabot) and 189.75 g. RT-455 D red pigment (DuPont) were added and mixing was continued for 30 minutes; 1000 g. preheated Isopar L were then added and the mixing continued for 1 hour. The mixture was allowed to cool while continuing stirring until the temperature reached 40° C.

(b) An S-1 attritor with 3/16" stainless steel balls was charged with 940 g. of the product from part (a) and 940 g. Isopar L. The mixture was ground for 22 hours; the final average particle size was 1.6 microns.

(c) The product of part (b) was diluted to a 3.0% solids content with Isopar H, and 750 grams of it were mixed with 750 g. of the diluted product of part (a) of Example I, which had already been separately diluted to a 3.0% solids content with Isopar H, and with 10 ml. of 18% Zirconium Octoate (Nuxtra, Nuodex Inc.) and 3 ml. OLOA 1200 (Oronite Division of Chevron Chemical Co.). In this mixture, both the Zirconium Octoate and the OLOA act as charge directors and render the black pigmented particles negatively charged and the red pigmented particles positively charged. While the mechanism of action of the two charge directors is at present not entirely understood, it is believed that one charge director renders the black pigmented particles negatively charged, and that the other charge director renders the red pigmented particles positively charged.

EXAMPLE VI (a) An S-O attritor with 3/16" stainless steel balls was charged with 100 g. of the product from part (b) of Example I, 2.8 g. blue pigment BT-383D (DuPont), 0.56 g. oxalic acid and 80 g. Isopar L. The mixture was ground for 21 hours; the final average particle size was 2.7 microns.

(b) The product of part (a) was diluted to a 3.0% solids content with Isopar H, and 800 grams of it were mixed with 800 grams of the diluted product of part (a) of Example I, which had already been separately diluted to a 3.0% solids content with Isopar H, and with 10 ml. of 10% lecithin solution (Fisher Scientific Co.) in Isopar H. In this mixture, the lecithin charge director renders the black pigmented particles negatively charged and the blue pigmented particles positively charged.

EXAMPLE VII (a) 1000 g. Elvax II 5720 resin (DuPont) and 500 g. Isopar L were mixed in a Ross double planetary mixer for 1 hour at 90° C., then for a further hour after addition of 250 g. Mogul L carbon black (Cabot) which had been wetted by 500 g. Isopar L, and finally for another hour after addition of 2000 g. Isopar L preheated to 110° C. Stirring was continued in absence of heating until the temperature reached 40° C. 3050 g. of the resultant mixture was milled in a Sweco M-18 vibratory mill (containing 0.5" alumina cylinders) with 4000 g. Isopar L for 20 hours at 40° C.; the average particle size of the product was 2.5 microns.

(b) An S-O attritor with 3/16" stainless steel balls was charged with 100 g. of the product from part (b) of Example I, 2.8 g. red pigment RT-455D (DuPont) and 70 g. Isopar L. The mixture was ground for 22 hours; the final average particle size was 1.6 microns.

(c) The product of part (a) was diluted to a 3.0% solids content with Isopar H, and 1000 grams of it were mixed with 10 ml. of 10% lecithin solution (Fisher Scientific Co.) in Isopar H.

(d) The product of part (b) was diluted to a 3.0% solids content with Isopar H, and 1000 grams of it were mixed with 1 ml. of SN-6535 B (Philip A. Hunt Chemical Corp.).

(e) The products of parts (c) and (d) were mixed together after 1 hour. In this mixture, the lecithin and SN-6535 B act as charge directors and render the black pigmented particles negatively charged and the red pigmented particles positively charged. While the mechanism of action of the two charge directors is at present not entirely understood, it is believed that one charge director renders the black pigmented particles negatively charged, and that the other charge director renders the red pigmented particles positively charged.

EXAMPLE VIII (a) An S-1 attritor with 3/16" stainless steel balls was charged with 1000 g. of the product from part (b) of Example I, 28 g. Helioecht Blue GO blue pigment (Bayer) and 700 g. Isopar L. The mixture was ground for 21 hours; the final average particle size was 2.1 microns.

(b) The product of part (a) of Example VII was diluted to a 3.0% solids content with Isopar H, and 1500 grams of it were mixed with 6 ml. of 10% lecithin solution (Fisher Scientific Co.) in Isopar H.

(c) The product of part (a) of Example VIII was diluted to a 3.0% solids content with Isopar H, and 1500 grams of it were mixed with 0.75 ml. of SN-6535 B (Philip A. Hunt Chemical Corp.).

(d) The products of parts (b) and (c) were mixed together after 3 hours. In this mixture, the lecithin and SN-6535 B act as charge directors and render the black pigmented particles negatively charged and the blue pigmented particles positively charged. While the mechanism of action of the two charge directors is at present not entirely understood, it is believed that one charge director renders the black pigmented particles negatively charged, and that the other charge director renders the blue pigmented particles positively charged.

While the invention has been particularly described with respect to certain embodiments, it will be appreciated by the person skilled in the art that many modifications and variations may be made. The invention is therefore not to be regarded as limited to such embodiments, which are merely illustrative. Rather, the invention is defined only in accordance with the claims which follow.

We claim:

1. A method for maintaining first and second concentrations of respective first and second charge directors at respective given first and second values in a toner composition comprising pigmented particles, said method comprising the following steps:

developing at least one color patch using said toner composition and obtaining measurements of the optical densities of said at least one color patch;

obtaining a measurement of the conductivity of said toner composition and comparing said conductivity to a reference;

determining the respective amounts of said first and second charge directors which need to be added to said composition to restore said first and second concentrations of first and second charge directors in said toner composition to said respective first and second given values; and adding respective amounts of said first and second charge directors to said composition.

2. A method according to claim 1 and also including the step of removing pigmented particles from a sample of said toner composition and measuring the amount of absorption of light of at least one given wavelength by said sample.

3. A method for maintaining first and second concentrations of respective first and second charge directors at respective given first and second values in a toner composition comprising pigmented particles, said method comprising the following steps:

developing at least one color patch using said toner composition and obtaining measurements of the optical densities of said at least one color patch, removing pigmented particles from a sample of said toner composition and measuring the amount of absorption of light of at least one given wavelength by said sample;

determining the respective amounts of said first and second charge directors which need to be added to said composition to restore said first and second concentrations of first and second charge directors in said toner composition to said respective first and second given values; and adding respective amounts of said first and second charge directors to said composition.

4. A method for maintaining first and second concentrations of respective first and second charge directors at respective given first and second values in a toner composition comprising pigmented particles, said method comprising the following steps:

obtaining a measurement of the conductivity of said toner composition and comparing said conductivity to a reference, removing pigmented particles from a sample of said toner composition and measuring the amount of absorption of light of at least one given wavelength by said sample;

determining the respective amounts of said first and second charge directors which need to be added to said composition to restore said first and second concentrations of first and second charge directors in said toner composition to said respective first and second given values; and adding respective amounts of said first and second charge directors to said composition.

* * * * *